US010422556B2

(12) United States Patent
Brun et al.

(10) Patent No.: US 10,422,556 B2
(45) Date of Patent: Sep. 24, 2019

(54) THERMOELECTRIC TEMPERATURE-CONTROL UNIT AND TEMPERATURE-CONTROL DEVICE

(71) Applicant: Mahle International GmbH, Stuttgart (DE)

(72) Inventors: Michael Brun, Rustenhart (FR); Timo Henke, Kernen/Rommelshausen (DE); Stefan Hirsch, Stuttgart (DE); Karl-Gerd Krumbach, Burgstetten (DE); Thomas Kuznia, Esslingen (DE); Gilles Magnier, Rougemont-le-Chateau (FR); Jerome Stoeckel, Bollwiller (FR); Manuel Wehowski, Stuttgart (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 15/776,785

(22) PCT Filed: Nov. 11, 2016

(86) PCT No.: PCT/EP2016/077475
§ 371 (c)(1),
(2) Date: May 16, 2018

(87) PCT Pub. No.: WO2017/084981
PCT Pub. Date: May 26, 2017

(65) Prior Publication Data

US 2018/0328630 A1 Nov. 15, 2018

(30) Foreign Application Priority Data

Nov. 17, 2015 (EP) ..... 15195004

(51) Int. Cl.
*F25B 21/02* (2006.01)

(52) U.S. Cl.
CPC ..... *F25B 21/02* (2013.01); *F25B 2321/02* (2013.01); *F25B 2321/023* (2013.01); *F25B 2321/0212* (2013.01)

(58) Field of Classification Search
CPC ..... F25B 21/02–04; F25B 2321/02; F25B 2321/023
See application file for complete search history.

(56) References Cited

U.S. PATENT DOCUMENTS

| | | | | |
|---|---|---|---|---|
| 7,958,736 | B2 | 6/2011 | Banerji et al. | |
| 9,377,222 | B2 | 6/2016 | Roll et al. | |
| 2004/0177623 | A1* | 9/2004 | Zelissen ..... | B60H 1/00478 62/3.7 |

FOREIGN PATENT DOCUMENTS

| | | | |
|---|---|---|---|
| DE | 102013212511 | A1 | 12/2014 |
| GB | 2494880 | A | 3/2013 |
| JP | 2008277394 | A | 11/2008 |

OTHER PUBLICATIONS

English abstract for JP-2008277394.

* cited by examiner

*Primary Examiner* — Tareq Alosh
(74) *Attorney, Agent, or Firm* — Fishman Stewart PLLC

(57) ABSTRACT

A thermoelectric temperature-control unit may include a first contact plate, a second contact plate, and at least one plate-shaped thermoelectric transducer. The thermoelectric transducer may have a first transducer side and a second transducer side facing away from the first transducer side. The thermoelectric transducer may be coupled to the first contact plate on the first transducer side and coupled to the second contact plate on the second transducer side. At least one of the first contact plate and the second contact plate may include a coupling zone on a respective inner side. A circumference of the coupling zone may be surrounded by a (Continued)

groove. A heat-conducting material may be arranged in the groove and along the coupling zone, and may directly contact the i) respective inner side and ii) one of the first transducer side and the second transducer side facing the respective inner side.

20 Claims, 5 Drawing Sheets

THERMOELECTRIC TEMPERATURE-CONTROL UNIT AND TEMPERATURE-CONTROL DEVICE

CROSS-REFERENCE TO RELATED APPLICATIONS

This application claims priority to International Patent Application No. PCT/EP2016/077475, filed on Nov. 11, 2016, and European Patent Application No. 15195004.5, filed on Nov. 17, 2015, the contents of both of which are hereby incorporated by reference in their entirety.

TECHNICAL FIELD

The present invention relates to a thermoelectric temperature-control unit. The invention also relates to a temperature-control device which is equipped with at least one such temperature-control unit.

BACKGROUND

Such a temperature-control unit usually comprises a first contact plate, a second contact plate and at least one plate-shaped thermoelectric transducer which has a first transducer side and a second transducer side, facing away therefrom, wherein the respective thermoelectric transducer is arranged between the first contact plate and the second contact plate in such a way that it is coupled in a heat-transmitting fashion by its first transducer side to the first contact plate, and is coupled in a heat-transmitting fashion by its second transducer side to the second contact plate.

A thermoelectric transducer in this context usually comprises a multiplicity of thermoelectric semiconductor elements with positive and negative doping, which semiconductor elements are connected to one another via conductor brides. These semiconductor elements are expediently enclosed in a hermetically sealed fashion with the conductor bridges in a plate-shaped housing, wherein the large, planar sides of the housing, facing away from one another, form the two transducer sides of the respective thermoelectric transducer. The respective thermoelectric transducer can convert an electric current into a heating current, which is based on the Peltier effect. Correspondingly, such a thermoelectric transducer can also be referred to as a Peltier element. Conversely, such thermoelectric transducers can also convert a heating current into an electric current, which is based on the Seebeck effect. In addition, by using such thermoelectric transducers it is therefore possible, by means of corresponding energization, to conduct away heat, that is to say to cool, selectively on the one transducer side and to feed in heat, that is to say to heat, on the other transducer side. Such thermoelectric temperature-control units, which are expediently equipped with a plurality of such thermoelectric transducers, can therefore be used in temperature-control devices, for example, to cool a heat source or to heat a heat sink. Likewise, by using such a temperature-control device, it is conceivable to utilize the temperature difference between a heat sink and a heat source to generate electrical energy.

In the case of high-power batteries such as are applied, for example, in electric vehicles, a large amount of heat is produced which has to be conducted away in order to improve the functionality, power and service life of the battery. In addition, at low ambient temperatures there is also definitely a need to raise the temperature of such a high-power battery to an operating temperature, that is to say to heat it, so that it can produce its power. Accordingly, such temperature-control devices can preferably be used in high-power batteries of this type in order to heat and cool them, as appropriate. Since such a temperature-control device can cool and heat according to requirements, the term "temperature-control" includes the terms "cool" and "heat" in the present context.

It is problematic with such temperature-control units that the contact plates, on the one hand, and the thermoelectric transducers, on the other, are subjected to different temperatures and accordingly different, thermally conditioned expansion effects. In particular, relative movements can occur here between the respective thermoelectric transducer and the contact plates. Such relative movements can adversely affect the heat-transmitting coupling between the transducer and the contact plates.

A temperature-control unit of the generic type is known, for example, from DE 10 2013 212 511 A1. In order to reduce the influence of thermal expansion effects, there is provision in the known temperature-control device to segment the respective contact plate using expansion joints, and to couple the individual segments to one another using spring structures. The implementation of such a design is comparatively costly.

SUMMARY

The present invention is concerned with the problem of specifying for such a thermoelectric temperature-control unit, or for a temperature-control device which is equipped therewith, an improved embodiment which is distinguished, in particular, by the fact that thermally conditioned relative movements between the thermoelectric transducer and the contact plates have a reduced influence on the heat-transmitting coupling between the transducer and the contact plates.

This problem is achieved according to the invention by means of the subject matter of the independent claim(s). Advantageous embodiments are the subject matter of the dependent claim(s).

The present invention is based on the general concept of mounting the respective thermoelectric transducer in a floating fashion at least on one of the contact plates using a heat-conducting material. As a result, relative movements can be made possible without excessively large stresses occurring and without the heat-transmitting coupling between the respective transducer and the respective contact plate being adversely affected. In particular, such a floating mounting can be implemented even in the case of a continuous contact plate, with the result that the implementation expenditure is relatively low.

In particular, the invention proposes that, in the region of the respective thermoelectric transducer, at least one such contact plate is equipped, on an inner side facing the respective other contact plate, with a coupling zone which is surrounded along its circumference by a groove formed in the inner side. In this groove and along the coupling zone, a heat-conducting material is arranged which is directly in contact, with the inner side of the respective contact plate on the one hand, and with the respective transducer side, on the other. The heat-conducting material can be deformable elastically and/or plastically. The deformability is to be understood here with reference to the customary operating temperatures to which the temperature-control unit is usually subjected. The heat-conducting material can be a pasty substance. At any rate, the heat-conducting material can follow thermally conditioned relative movements between the respective transducer and the respective contact plate and in the process continuously maintain the contact with the contact plate and the transducer, with the result that the desired heat-transmitting coupling is always provided between the transducer and the contact plate.

According to one advantageous embodiment, the respective groove can be arranged all around a circumferential edge of the respective thermoelectric transducer. Therefore, the respective transducer is ultimately completely surrounded by the heat-conducting material arranged in the groove. Accordingly, the transducer can move relative to the coupling plate in any desired direction within the plane of the plate, without leaving the region of the heat-conducting material.

In another advantageous embodiment, the respective groove can have, in the profile, two groove edges facing one another, specifically a groove inner edge which lies further inwards in relation to the respective thermoelectric transducer, and a groove outer edge which lies further outwards in relation to the latter. The respective groove is now positioned in such a way that a circumferential edge of the respective thermoelectric transducer is arranged between the groove inner edge and the groove outer edge. This relative position relates here to a point of view perpendicular to the plane of the respective contact plate or to a projection which is oriented perpendicularly with respect to the plane of the contact plate.

As a result of this arrangement of the circumferential edge of the transducer between the groove inner edge and the groove outer edge, relative movements to both sides transversely with respect to the longitudinal direction of the groove, that is to say inwardly and outwardly oriented movements, can be compensated in the plane of the plates.

In a further embodiment, the coupling zone can be countersunk with respect to a surrounding region of the respective inner side, the surrounding region being located on a side of the groove facing away from the coupling zone. The respective groove is itself countersunk with respect to this surrounding region and with respect to the coupling zone. The countersunk coupling zone permits more heat-conducting material to be accommodated between the inner side and the transducer side. It is therefore possible, on the one hand, to improve the transmission of heat. On the other hand, this also permits the compensation capability with respect to relative movements to be improved.

In another embodiment, a plurality of elevated portions, which are elevated with respect to the rest of the coupling zone, can be formed in the coupling zone. As a result of these elevated portions within the coupling zone, the mechanical support of the contact plate on the transducer or on the transducer housing can be improved. However, this support does not necessarily require direct contact between the elevated portions and the respective transducer side. In particular, the support can be provided indirectly via the heat-conducting material.

In one advantageous development it is possible to provide that the coupling zone is countersunk with respect to the surrounding region only outside the elevated portions. In other words, the elevated portions do not have to be countersunk themselves with respect to the surrounding region. Therefore, a development is preferred in which the elevated portions lie flush in a common plane with the surrounding region. Such an embodiment can be manufactured particularly easily.

It is also possible to provide that the elevated portions are formed integrally on the respective inner side. This design can also be implemented particularly easily. Alternatively, it is basically possible to provide the elevated portions in the form of separate spacer elements which are arranged in a suitable way on the inner side in the coupling zone.

In another advantageous development, the thermoelectric transducer can be also in contact with the respective inner side via the heat-conducting material in the region of the elevated portions. A heat-transmitting coupling is therefore also present between the elevated portions and the respective transducer side, which improves overall the transmission of heat between the transducer and the affected contact plate.

In another embodiment, the respective thermoelectric transducer can be in contact with the inner side of the respective contact plate exclusively via the heat-conducting material, at least on one of the transducer sides of said thermoelectric transducer. In other words, in this embodiment direct, immediate contact between the transducer side and the inner side of the contact plate is precluded. This measure brings about improved transfer of heat between the transducer and contact plate.

In another embodiment, the two contact plates can each have, in the region of at least one such thermoelectric transducer, one such coupling zone which is surrounded by one such groove. It is preferred here that the respective thermoelectric transducer is in contact with the respective inner side of the respective contact plate in each case via such a heat-conducting material on the two transducer sides of said thermoelectric transducer. The transducer can therefore also carry out relative movements with respect to the two contact plates on both transducer sides, said relative movements being compensated by the heat-conducting material.

According to one advantageous development there can be provision that only the coupling zone of the one contact plate is provided with the elevated portions specified above. The other coupling zone is then expediently configured in a planar fashion, that is to say without such elevated portions.

In other advantageous development, the coupling zone of the other contact plate can lie flush in a common plane with a surrounding region of the associated inner side which is located on a side of the associated groove facing away from the coupling zone. This measure also brings about intensive support of the respective contact plate within the respective coupling zone via the heat-connecting material on the respective transducer.

In another advantageous embodiment, the respective groove can be formed by a stamped formation on the respective inner side. Such stamped grooves can be implemented particularly easily on such a contact plate. In particular, such a stamping method is suitable for series manufacture of the contact plates or of the temperature-control units. Provided that the specified elevated portions are provided in the respective coupling zone and/or that the respective coupling zone is arranged countersunk with respect to the surrounding region of the associated inner side, the respective coupling zone can also be manufactured on the inner side by means of a stamped formation.

The elevated portions can basically have any desired geometries or cross sections, wherein the geometry relates here to a projection perpendicular to the plane of the respective contact plate, while the cross section lies in a plane of intersection which runs parallel to the plane of the contact plate. Rectangular, in particular square, or round, in particular circular, cross sections are conceivable for the elevated portions. Basically, any other desired non-round or polygonal cross sections are also conceivable. The elevated portions can be implemented with different sizes in order also to implement a different density of such elevated portions within the respective coupling zone. The density and geometry of the elevated portions can depend, for example, on the supporting loads which have to be transmitted to the respective transducer between the contact plates.

A temperature-control device according to the invention has a cooling region which can be coupled in a heat-transmitting fashion to a heat sink, indirectly via a cooling path of the temperature-control device or directly, and a heating region which can be coupled in a heat-transmitting fashion to a heat source, indirectly via a heating path of the temperature-control device or directly. Furthermore, the respective temperature-control device has at least one thermoelectric temperature-control unit of the type described above. The respective temperature-control unit is integrated here into a heat-transmitting coupling between the cooling region and the heating region in such a way that the one contact plate is coupled in a heat-transmitting fashion to the cooling region, while the other contact plate is coupled in a heat-transmitting fashion to the heating region. Therefore, during the operation of the temperature-control device it is possible, depending on the polarity of the selected energization of the respective thermoelectric transducer, to heat the heat sink or to cool the heat source, or correspondingly vice versa. For example, such a temperature-control device can be used in a high-power battery. Such high-power batteries usually have a plurality of plate-shaped battery elements or battery cells which are stacked one on top of the other in a stacking direction. Between adjacent battery cells it is possible to integrate in each case a cooling plate, integrated into a cooling path, into the stack, wherein in each case such a temperature-control device can also be integrated into the stack in the stacking direction between each cooling plate and the adjacent battery cell. This results in a sequence within the stack, in which sequence a battery cell is followed by a temperature-control device, a cooling plate, a further temperature-control device and the next battery cell. During the operation of the battery, the battery cells generate heat which is to be conducted away, for example, to a cooling circuit of a vehicle via the cooling plate. This transmission of heat from the battery cells to the cooling plate can be assisted significantly by means of corresponding energization of the temperature-control devices. On the other hand, if the temperature of the battery cells is too low for a satisfactory operation, heat can also be selectively fed to the battery cells by means of corresponding energization of the temperature-control devices.

Such a temperature-control device can, in particular, also be configured as a heat exchanger in which a cooling path and a heating path are separated in terms of media and coupled in a heat-transmitting fashion.

Further important features and advantages of the invention can be found in the dependent claims, the drawings and the associated description of the figures with reference to the drawings.

Of course, the features which are specified above and those which are still to be explained below can be used not only in the respectively disclosed combination but also in other combinations or alone without departing from the scope of the present invention.

Preferred exemplary embodiments of the invention are illustrated in the drawings and are explained in more detail in the following description, wherein identical reference symbols relate to identical or similar or functionally identical components.

BRIEF DESCRIPTION OF THE DRAWINGS

In the drawings, in each case in a schematic form.

DETAILED DESCRIPTION

Figure 1:
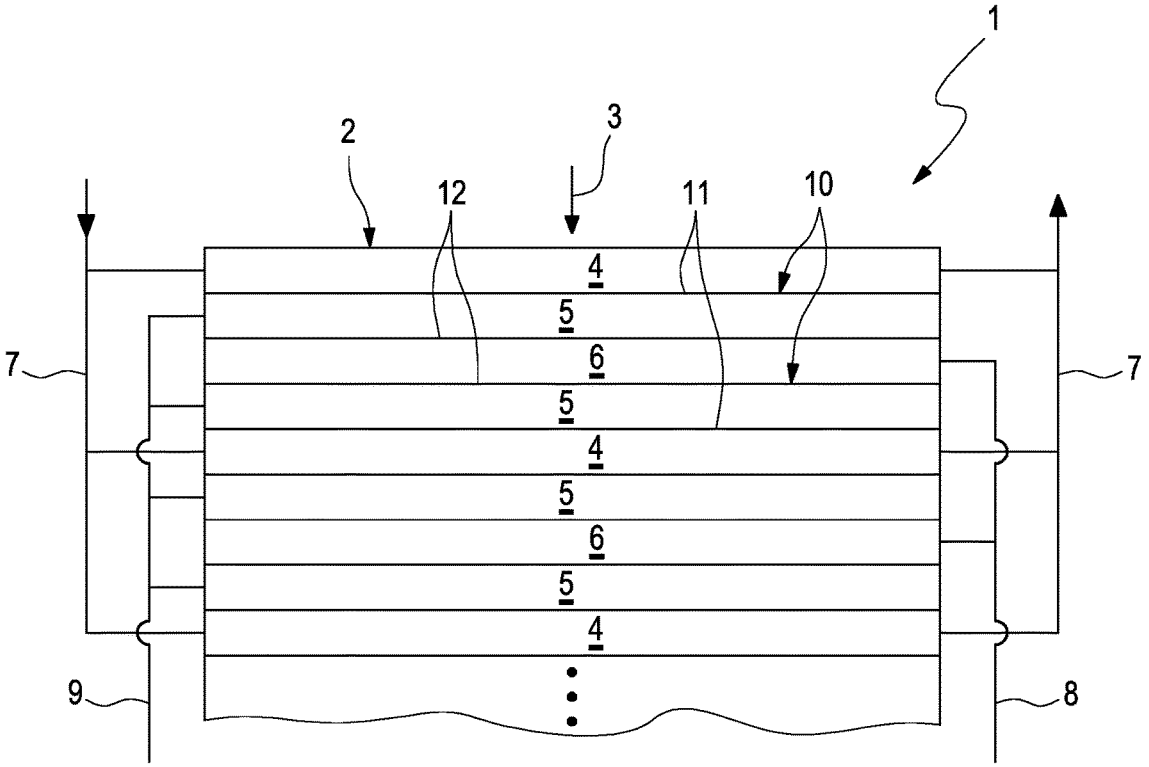
FIG. 1 shows a highly simplified basic side view of a high-power battery with an integrated temperature-control device which comprises a plurality of temperature-control units.

According to FIG. 1, a high-power battery 1 comprises a stack 2 in which plate-shaped cooling elements 4, plate-shaped temperature-control units 5 and plate-shaped battery elements 6 alternate in a stacking direction 3 in such a way that in each case a cooling element 4 is arranged between two adjacent battery elements 6, and that a temperature-control unit 5 is arranged between each cooling element 4 and each battery element 6. The plate-shaped cooling elements 4 can also be referred to as cooling plates 4 and are expediently connected to a cooling circuit 7 which is integrated, for example, into a cooling circuit of a vehicle which is equipped with the battery 1. The battery elements 6 can represent separate cells of the battery and can accordingly also be referred to as battery cells 6. The battery cells 6 are electrically connected to one another in a suitable way, for example via a battery cable 8 which is indicated here. The temperature-control units 5 can be actuated by means of a power supply 9 for heating or cooling the battery cells 6. The temperature-control units 5 each form here a component of a temperature-control device 10, which also has a cooling region 11 and a heating region 12. In the example shown here, the cooling region 11 is connected in each case directly to a heat sink, which is formed here in each case by such a cooling plate 4. The heating region 12 is connected directly to a heat source, which is formed here in each case by such a battery cell 6.

Figure 2:
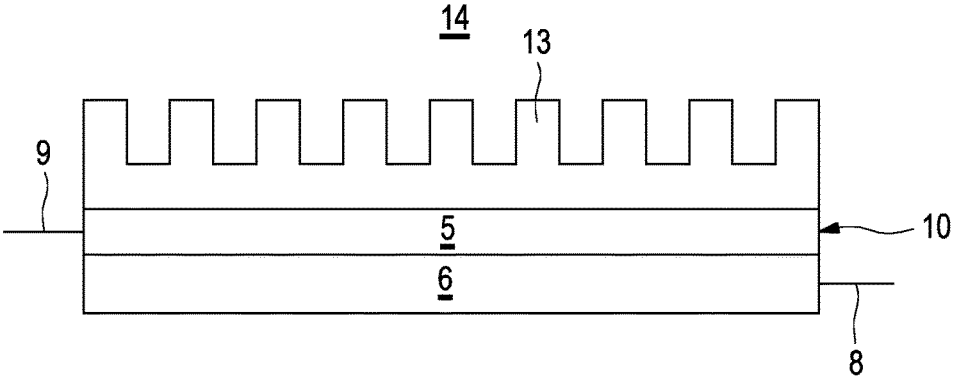
FIG. 2 shows a highly simplified side view of a temperature-control device with a single temperature-control unit for another application.

FIG. 2 shows another application of such a temperature-control device 10 which has, purely by way of example, just one such temperature-control unit 5 here. In this case, the temperature-control device 10 or the temperature-control unit 5 serves again to cool a battery cell 6. The temperature-control unit 5 is for this purpose coupled, on the one hand, in a heat-transmitting fashion to the battery cell 6 and, on the other hand, in a heat-transmitting fashion to a heat sink 13, in order to be able to irradiate heat from the battery cell 6, for example to surroundings 14.

Figure 3:
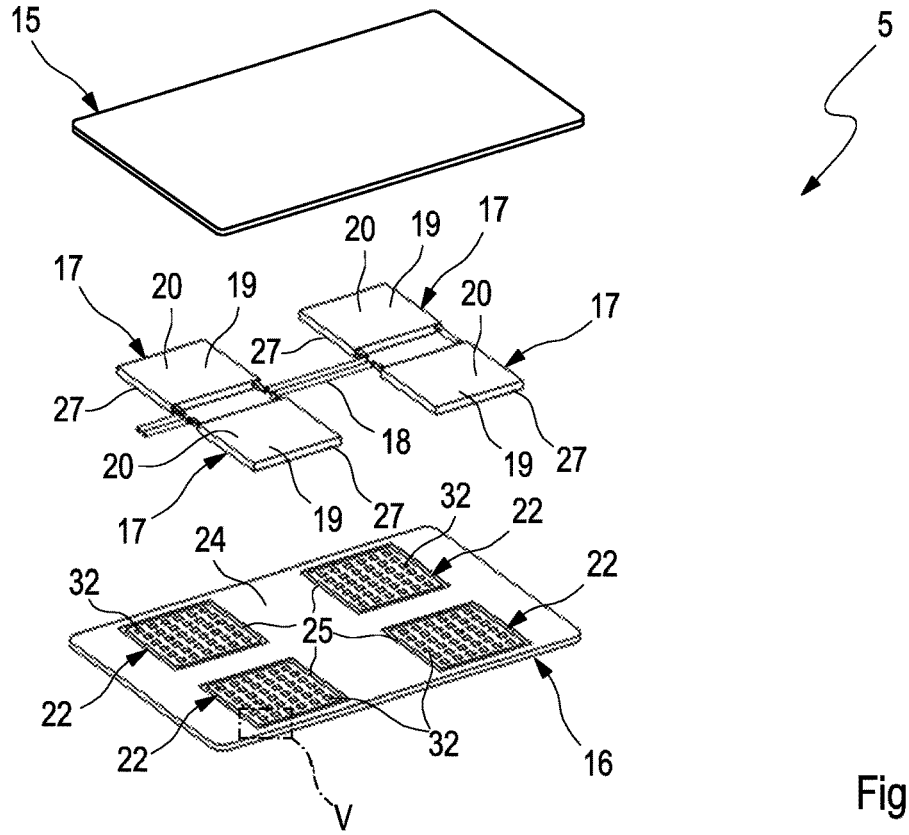
FIG. 3 shows an exploded illustration of such a temperature-control unit.
Figure 4:
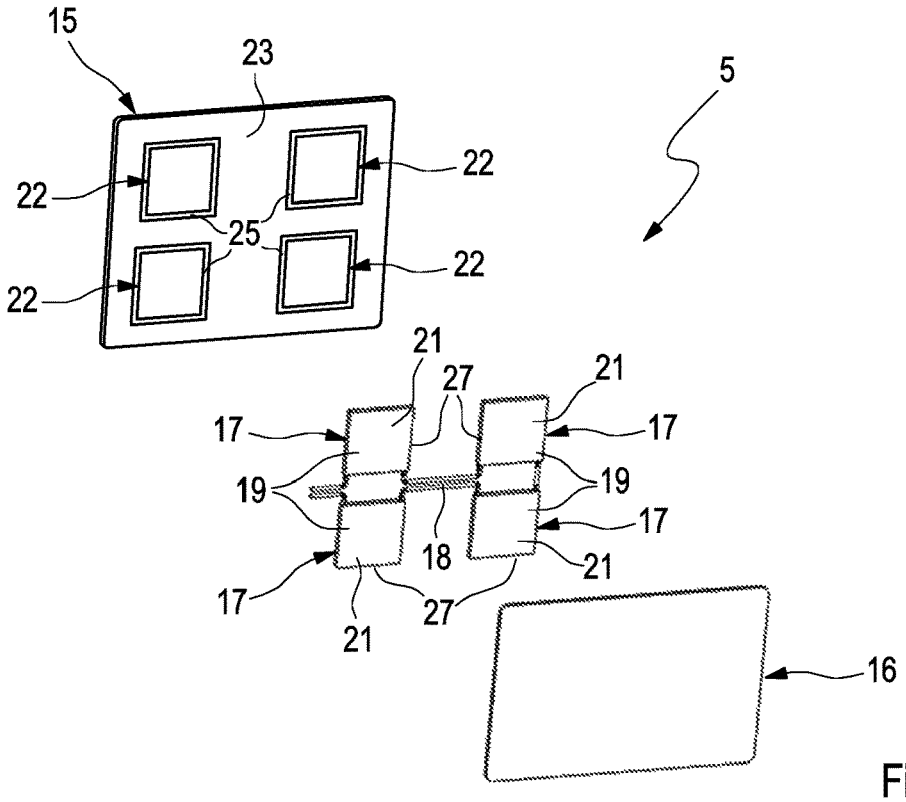
FIG. 4 shows a further exploded illustration of the temperature-control unit, but from another point of view.

According to FIGS. 3 and 4, a thermoelectric temperature-control unit 5 which can be applied in such a temperature-control device 10 comprises a first contact plate 15 and a second contact plate 16. Furthermore, the temperature-control unit 5 is equipped with at least one plate-shaped thermoelectric transducer 17 which is arranged between the two contact plates 15, 16. In the example in FIGS. 3 and 4, precisely four thermoelectric transducers 17 are provided which are connected to one another in a suitable way. Corresponding electric connecting lines are denoted by 18 in FIGS. 3 and 4. A series circuit of the thermoelectric transducers 17 can be seen here.

The respective thermoelectric transducer 17 has a housing 19 which is designed in the shape of a plate and which has two large, planar outer sides which face away from one another and which form two transducer sides of the transducer 17, specifically a first transducer side 20 facing the first contact plate 15, and a second transducer side 21 facing the second contact plate 16. In the assembled state, the respective first transducer side 17 is coupled in a heat-transmitting fashion to the first contact plate 15, while the respective second transducer side 21 is coupled in a heat-transmitting fashion to the second contact plate 16.

The respective housing 19 encloses, in a hermetically sealed fashion, a housing interior in which a multiplicity of thermoelectric elements are arranged in a customary fashion, said thermoelectric elements being connected to one another via conductor bridges. The thermoelectric elements are n-doped and p-doped semiconductor elements which convert an electric current into a heating current or convert a heating current into an electric current.

Figure 5:
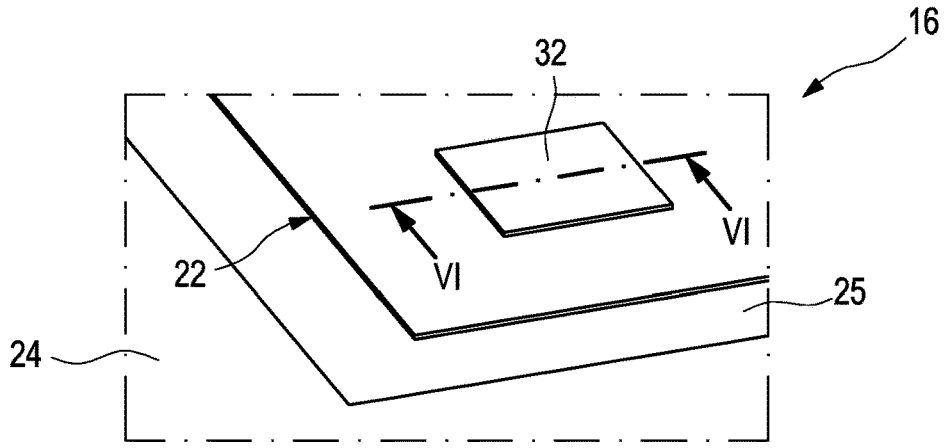
FIG. 5 shows an enlarged view of a detail V from FIG. 3.

According to FIG. 3, the second contact plate 16 has in each case one coupling zone 22 for each transducer 17. According to FIG. 4, the first contact plate 15 also has such a coupling zone 22 for each transducer 17. In the example shown, in each case four separate coupling zones 22 are accordingly provided on the two contact plates 15, 16. A small detail of such a coupling zone 22 is represented in FIG. 5 on an enlarged scale. A cross section through the temperature-control unit 5 in the region of such a transducer 17 is represented in FIG. 6, wherein the profile of a corresponding sectional line VI is indicated in FIG. 5.

Figure 6:
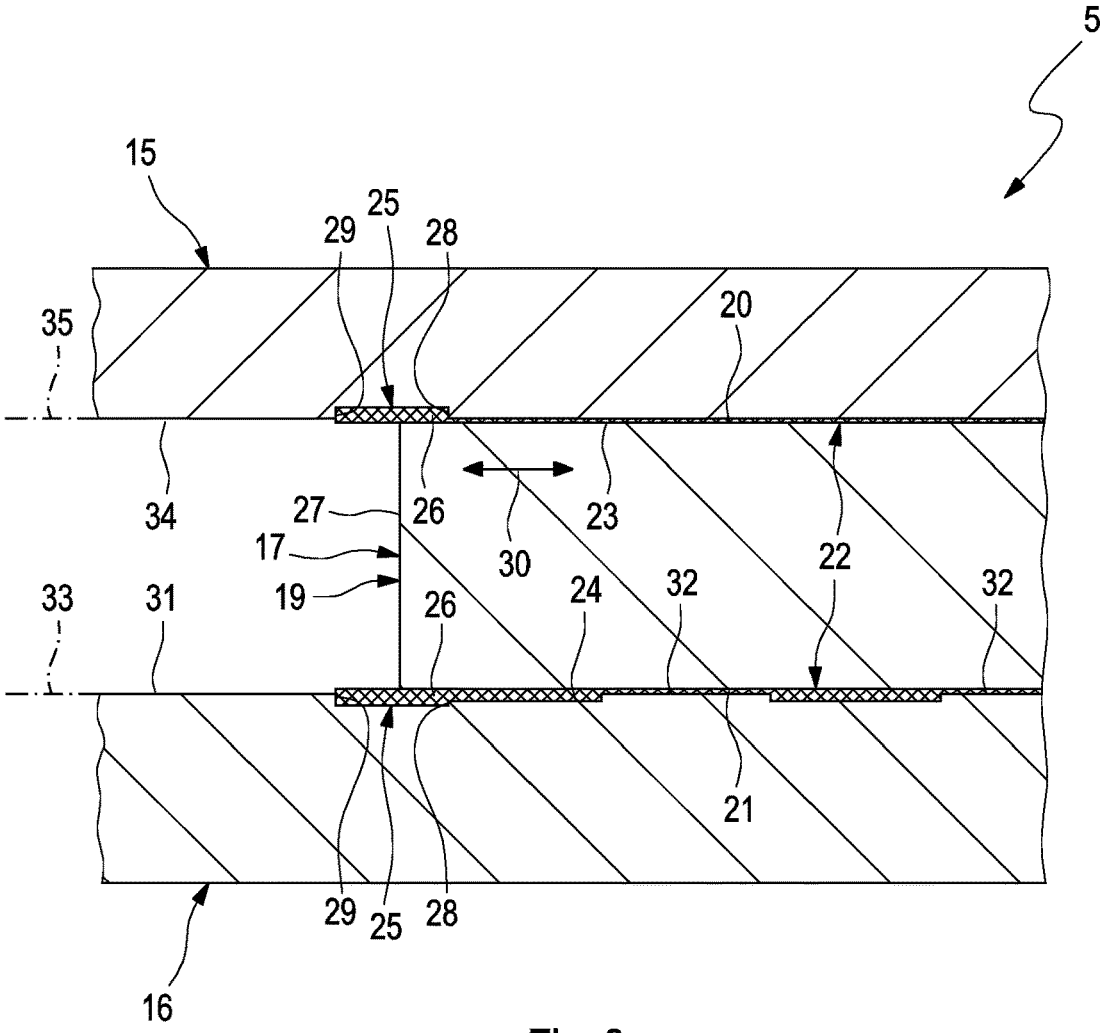
FIG. 6 shows an enlarged sectional view of the temperature-control device in the region of a thermoelectric transducer.
Figure 7:
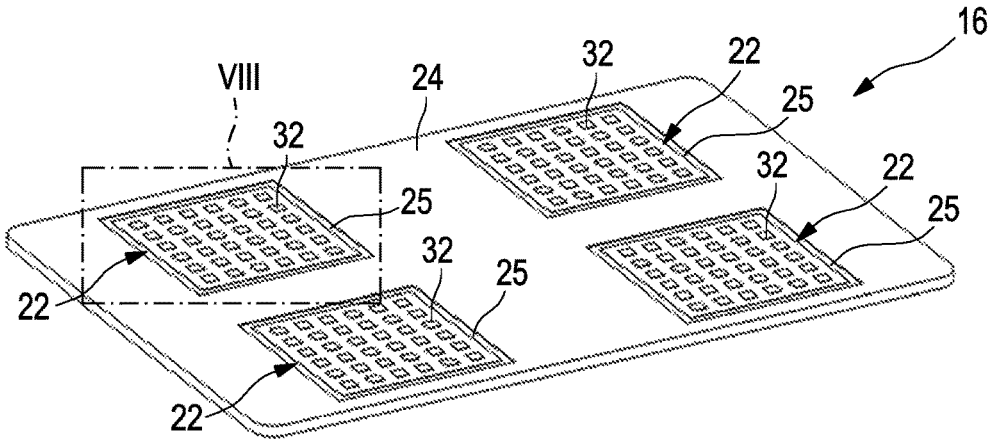
FIG. 7 shows an isometric view of a contact plate of the transducer.
Figure 8:
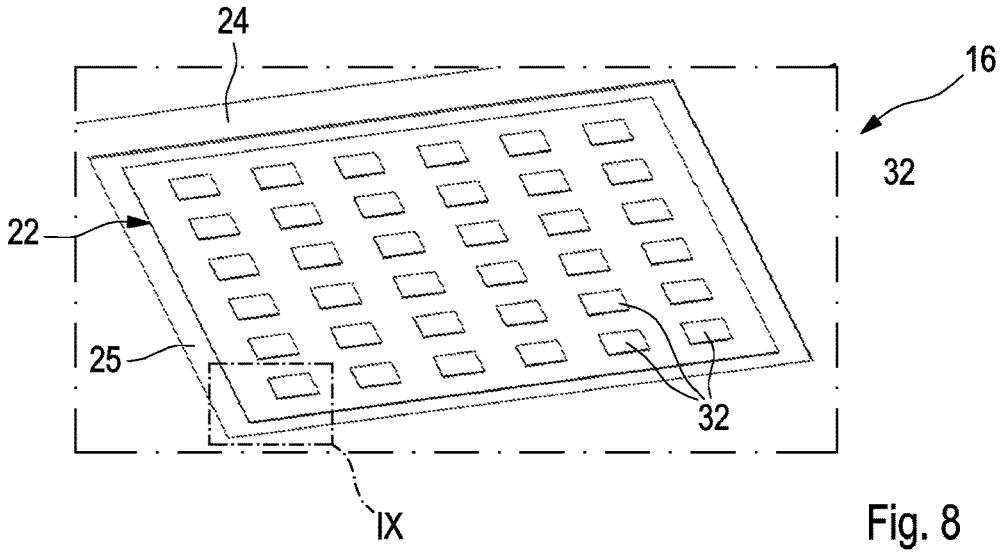
FIG. 8 shows an enlarged isometric view of a detail VIII from FIG. 7.
Figure 9:
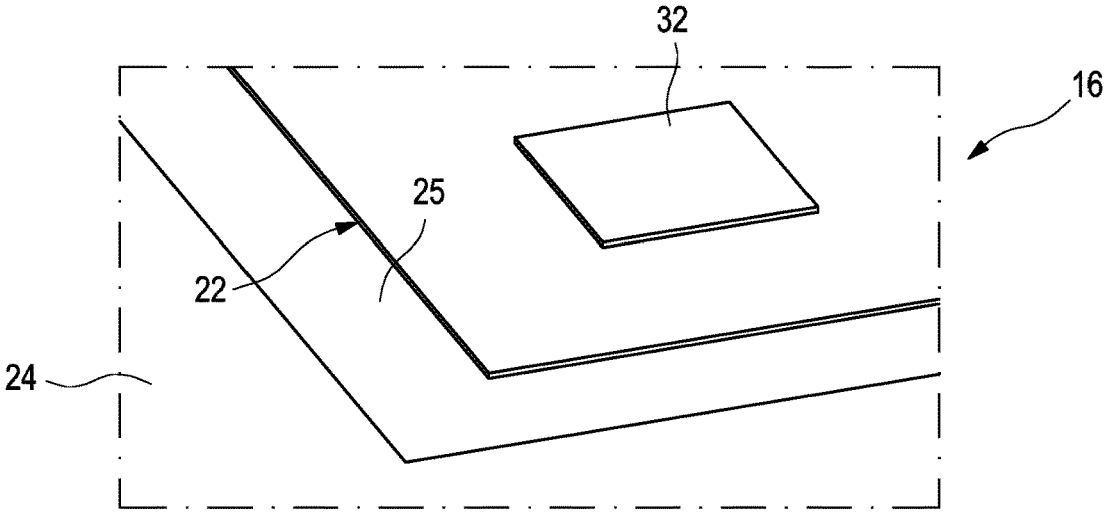
FIG. 9 shows an enlarged isometric view of a detail IX from FIG. 8, and FIGS. 10 to 14 show plan views of a coupling zone in various embodiments.

The coupling zones 22 are each formed here, in particular according to FIG. 6, on an inner side 23 of the first contact plate 15 or on an inner side 24 of the second contact plate 16. The inner side 23 of the first contact plate 15 faces the second contact plate 16. The inner side 24 of the second contact plate 16 faces the first contact plate 15.

According to FIGS. 3 to 6 and 7 to 9, the respective coupling zone 22 is surrounded along its circumference by a groove 25 which is formed in the respective inner side 23 or 24. A heat-conducting material 26 is arranged in this groove 25, along the respective coupling zone 22. The heat-conducting material 26 can be formed by a highly viscous substance which is therefore capable of flowing and can accordingly follow relative movements between the transducer 17 and the respective contact plate 15, 16. This heat-conducting material 26 is directly in contact, on the one hand, with the respective inner side 23 or 24 of the respective contact plate 15, 16 and, on the other hand, with the respective transducer side 20, 21. As a result, the transmission of heat between the transducer 17 and the respective contact plate 15, 16 is improved. For this purpose, the heat-conducting material 26 has a relatively high heat conduction coefficient. The main effect of the heat-conducting material 26 is, however, the fact that distances between the respective transducer side 20, 21 and the respective inner side 23, 24 are filled in by the heat-conducting material 26, with the result that heat is transmitted in these regions by conduction of heat. Due to tolerances, the respective transducer side 20, 21 generally cannot bear with its complete surface against the respective inner side 23, 24 when heat-conducting material 26 is absent. In the microstructure which is actually present, there are, even with planar contact faces, always only local, punctiform contact points owing to rough areas on surfaces, with the result that apart from these punctiform contact points there is a varying distance between the respective transducer side 20, 21 and the respective inner side 23, 24, in which transmission of heat occurs only through radiation of heat, which is, for example, an order of magnitude smaller than the transmission of heat through conduction of heat. Even if the heat-conducting material 26 itself were therefore to have a smaller heat conduction coefficient than the material of the transducer sides 20, 21 and/or of the inner sides 23, 24, significantly improved transmission of heat would occur as a result of the changeover from radiation of heat to conduction of heat.

As is apparent, in particular, from FIGS. 3, 4, 7, 8 and 10 to 14, the respective groove 25 is expediently configured in such a way that it is arranged running all along a circumferential edge 27 of the respective transducer 17. In the case of the transducers 17 with a rectangular cross section, as shown here, a corresponding rectangular geometry is obtained for the circumferential groove 25.

As is apparent from FIG. 6, in the cross section in FIG. 6 which lies in a plane which extends perpendicularly to the plane of the planar contact plates 15, 16, two groove edges facing one another are provided in the profile of the respective groove 25, these being specifically a groove inner edge 28 which lies further inwards in relation to the respective transducer 17 and a groove outer edge 29 which lies further outwards in relation to the transducer 17. The groove 25 is positioned in relation to the circumferential edge 27 of the transducer 17 in such a way that in a direction 30 of extent running parallel to the planes in which the planar contact plates 15, 16 lie, the circumferential edge 27 is arranged between the groove inner edge 28 and the groove outer edge 29.

As is apparent from FIG. 6, in the case of the second contact plate 16 there is provision that the coupling zone 22 is countersunk with respect to a surrounding region 31 of the associated inner side 24. The surrounding region 31 is located here on a side of the groove 25 facing away from the coupling zone 22 and completely surrounds the groove 25. In the case of the second contact plate 16, the associated groove 25 is formed countersunk with respect to this surrounding region 31 and with respect to the coupling zone 22.

According to FIGS. 3, 5 to 9 and 11 to 14 there is provision in the case of the second contact plate 16 that a plurality of elevated portions 32 are formed in the respective coupling zone 22. These elevated portions 32 are elevated with respect to the rest of the coupling zone 22. In other words, the elevated portions 32 protrude with respect to the rest of the coupling zone 22, in the direction of the respective transducer 17. In particular, it is possible to provide that the coupling zone 22 is countersunk with respect to the surrounding region 31 only outside these elevated portions 32. In other words, according to one specific embodiment it is possible to provide that the elevated portions 32 lie flush with the surrounding region 31 in a common plane 33 which is indicated in FIG. 6. The elevated portions 32 are preferably formed integrally on the respective inner side 24. Likewise, in FIG. 6 it is apparent that the transducer 17 is also in contact with the respective inner side 24 in the region of the elevated portions 32 exclusively via the heat-conducting material 26. Therefore, an embodiment is implemented here in which the transducer 17 is in contact with the inner side 23 or 24 of the respective contact plate 15, 16 exclusively via the heat-conducting material 26, at least on one of its transducer sides 20, 21, here on both transducer sides 20, 21.

In the examples shown here, in the region of the transducers 17 the two contact plates 15, 16 each have such a coupling zone 22 which is surrounded in each case by such a groove 25. Likewise, the transducers 17 are in contact with the respective inner side 23, 24 of the respective contact plate 15, 16 in each case via such a heat-conducting material 26, on the two transducer sides 20, 21 of said transducers 17. In addition there is provision here that only the coupling zones 22 of the second contact plate 16 are provided with such elevated portions 32. In contrast to this, the coupling zone 22 of the first contact plate 15 is configured in a completely planar fashion, wherein the term "completely" is to be understood within the scope of the customary manufacturing tolerances. In particular there is provision here that the coupling zone 22 of the first contact plate 15 lies flush in a common plane 35 with a surrounding region 34 of the associated inner side 23. This surrounding region 34 is also located here on a side of the associated groove 25 facing away from the coupling zone 22, with the result that the surrounding region 34 completely surrounds the associated groove 25.

The respective groove 25 is preferably formed on the respective inner side 23, 24 by means of a stamping process. Provided that the coupling zone 22 is arranged countersunk with respect to the surrounding region 31, this can also be implemented by means of a stamping process. The configuration of the elevated portions 32 also can be carried out by means of stamping, for example in that the coupling zone 22 is stamped outside the elevated portions 32.

Figure 10:
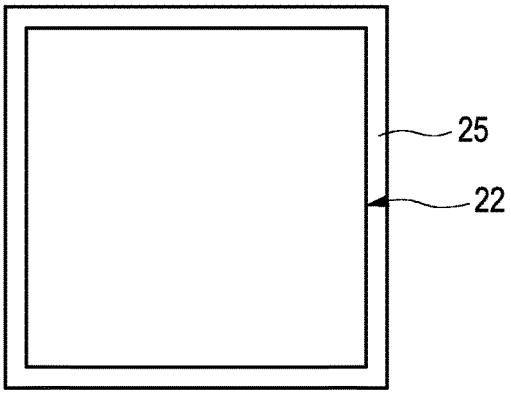
Figure 11:
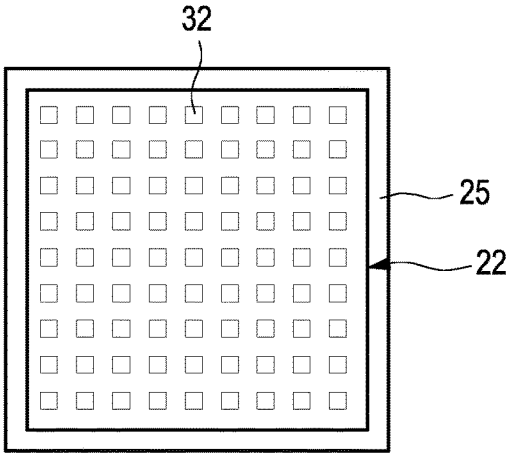
Figure 12:
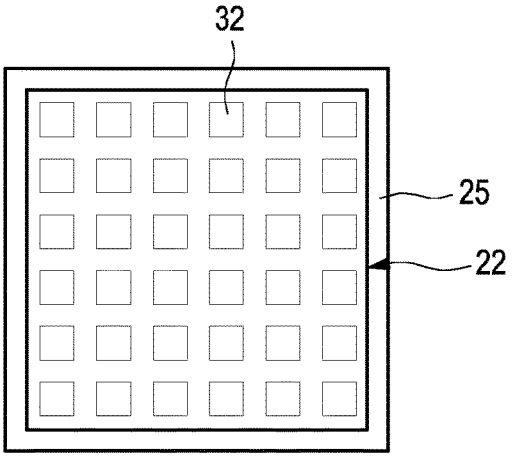
Figure 13:
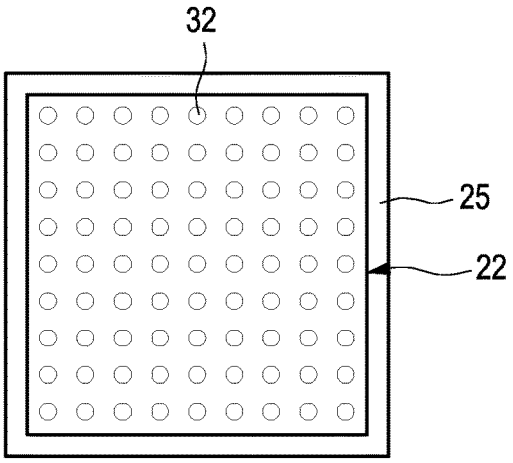
Figure 14:
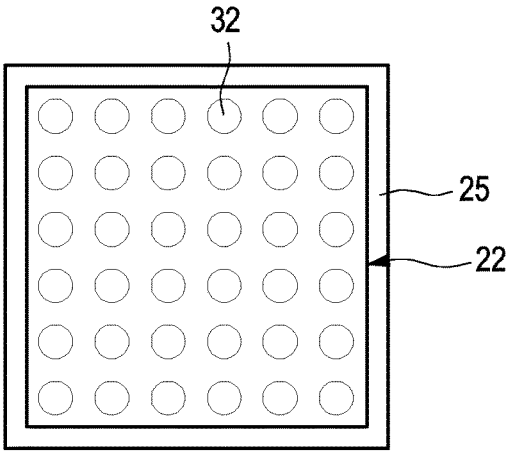

FIG. 10 shows a coupling zone 22 without elevated portions 32. For example, such a coupling zone 22 is located on the first contact plate 15. In contrast to this, FIGS. 11 to 14 show various examples of coupling zones 22 which are each equipped with elevated portions 32. These coupling zones 22 are preferably located on the second contact plate 16. The elevated portions 32 can be seen to have rectangular, in particular square, cross sections, as illustrated in FIGS. 11 and 12, in a viewing direction which is oriented perpendicularly to the plane in which the respective planar contact plate 15, 16 extends. Likewise, round, in particular circular, cross sections are possible, as illustrated in FIGS. 13 and 14. In addition, the elevated portions 32 can be implemented with different densities within the respective coupling zone 22. For example FIGS. 11 and 13 show examples with a relatively high density of the elevated portions, while FIGS. 12 and 14 show examples of a smaller density of the elevated portions.

The invention claimed is:

1. A thermoelectric temperature-control unit comprising:

a first contact plate;

a second contact plate; and at least one plate-shaped thermoelectric transducer having a first transducer side and a second transducer side facing away from the first transducer side;

wherein the at least one thermoelectric transducer is arranged between the first contact plate and the second contact plate, is coupled in a heat-transmitting fashion to the first contact plate on the first transducer side, and is coupled to the second contact plate on the second transducer side;

wherein, in a region of the at least one thermoelectric transducer, at least one of the first contact plate and the second contact plate includes a coupling zone on a respective inner side facing the other of the first contact plate and the second contact plate, a circumference of the coupling zone surrounded by a groove disposed in the respective inner side;

wherein a layer of a heat-conducting material is arranged in the groove and on the coupling zone; and wherein the layer of the heat-conducting material directly contacts the respective inner side of the at least one of the first contact plate and the second contact plate and one of the first transducer side and the second transducer side facing the respective inner side.

2. The temperature-control unit according to claim 1, wherein the groove extends around a circumferential edge of the at least one thermoelectric transducer.

3. The temperature-control unit according to claim 1, wherein:

the groove is at least partially defined by two groove edges facing one another, the two groove edges including a groove inner edge lying further inwards in relation to the at least one thermoelectric transducer and a groove outer edge lying further outwards in relation to the at least one thermoelectric transducer than the groove inner edge; and the groove is arranged such that a circumferential edge of the at least one thermoelectric transducer is arranged between the groove inner edge and the groove outer edge.

4. The temperature-control unit according to claim 1, wherein:

the coupling zone is countersunk with respect to a surrounding region of the respective inner side, the surrounding region disposed on a side of the groove facing away from the coupling zone; and the groove is countersunk with respect to the surrounding region and with respect to the coupling zone.

5. The temperature-control unit according to claim 1, wherein the coupling zone includes a plurality of elevated portions elevated with respect to a non-elevated portion of the coupling zone.

6. The temperature-control unit according to claim 5, wherein the non-elevated portion of the coupling zone is countersunk with respect to the surrounding region.

7. The temperature-control unit according to claim 5, wherein the plurality of elevated portions lie flush in a common plane with a surrounding region.

8. The temperature-control unit according to claim 5, wherein the plurality of elevated portions are disposed integrally on the respective inner side.

9. The temperature-control unit according to claim 5, wherein the at least one thermoelectric transducer contacts the respective inner side via the layer of the heat-conducting material in a region of the plurality of elevated portions.

10. The temperature-control unit according to claim 1, wherein at least one of the first transducer side and the second side only contacts the respective inner side via the layer of the heat-conducting material.

11. The temperature-control unit according to claim 1, wherein:

the first contact plate and the second contact plate each include, in the region of the at least one thermoelectric transducer, a respective coupling zone surrounded by a respective groove; and the first transducer side and the second transducer side of the at least one thermoelectric transducer contact the respective inner side of the first contact plate and the second contact plate respectively via the layer of the heat-conducting material.

12. The temperature-control unit according to claim 11, wherein the respective coupling zone of one of the first contact plate and the second contact plate includes a plurality of elevated portions elevated with respect to a non-elevated portion of the respective coupling zone.

13. The temperature-control unit according to claim 12, wherein the respective coupling zone that does not include the plurality of elevated portions lies flush in a common plane with a surrounding region of the respective inner side, the surrounding region disposed on a side of the respective groove facing away from the respective coupling zone that does not include the plurality of elevated portions.

14. The temperature-control unit according to claim 1, wherein the groove is a stamped groove on the respective inner side.

15. A temperature-control device comprising:

a cooling region couplable to a heat sink such that heat is transferable therebetween one of i) directly and ii) indirectly via a cooling path;

a heating region couplable to a heat source such that heat is transferable therebetween one of i) directly and ii) indirectly via a heating path; and at least one thermoelectric temperature-control unit integrated into a heat-transmitting coupling between the cooling region and the heating region, the at least one temperature-control unit including:

a first contact plate having a first inner side;

a second contact plate having a second inner side facing the first inner side;

at least one plate-shaped thermoelectric transducer having a first transducer side coupled in a heat-transmitting fashion to the first contact plate and a second transducer side coupled in a heat-transmitting fashion to the second contact plate, the second transducer side facing away from the first transducer side;

wherein at least one of the first inner side and the second inner side includes a coupling zone in a region of the at least one thermoelectric transducer and a groove extending around the coupling zone circumferentially;

wherein a layer of a heat-conducting material is arranged within the groove and on the coupling zone such that the layer of the heat-conducting material contacts i) the at least one of the first inner side and the second inner side and ii) an associated transducer side of the first transducer side and the second transducer side coupled to the at least one of the first inner side and the second inner side; and wherein the first contact plate is coupled in a heat-transmitting fashion to the cooling region and the second contact plate is coupled in a heat-transmitting fashion to the heating region.

16. The temperature-control device according to claim 15, wherein the coupling zone includes a plurality of elevated portions elevated with respect to a non-elevated portion of the coupling zone.

17. A thermoelectric temperature-control unit comprising:

a first contact plate;

a second contact plate; and at least one plate-shaped thermoelectric transducer having a first transducer side and a second transducer side facing away from the first transducer side, the at least one thermoelectric transducer coupled in a heat-transmitting fashion to the first contact plate on the first transducer side and coupled in a heat-transmitting fashion to the second contact plate on the second transducer side such that the at least one thermoelectric transducer is arranged between the first contact plate and the second contact plate;

wherein, in a region of the at least one thermoelectric transducer, at least one of the first contact plate and the second contact plate includes a coupling zone on a respective inner side facing the other of the first contact plate and the second contact plate, a circumference of the coupling zone surrounded by a groove disposed in the respective inner side, the groove at least partially defined by two groove edges facing one another, the two groove edges including a groove inner edge and a groove outer edge, the groove inner edge lying further inwards in relation to the at least one thermoelectric transducer than the groove outer edge, the groove arranged such that a circumferential edge of the at least one thermoelectric transducer is arranged between the grove inner edge and the groove outer edge;

wherein a heat-conducting material is arranged in the groove and along the coupling zone, the heat-conducting material directly contacting i) the respective inner side of the at least one of the first contact plate and the second contact plate and ii) one of the first transducer side and the second transducer side facing the respective inner side; and wherein the coupling zone includes a plurality of elevated portions.

18. The temperature-control unit according to claim 1, wherein the at least one thermoelectric transducer is floatingly coupled to at least one of the first contact plate and the second contact plate via the layer of the heat-conducting material such that the at least one thermoelectric transducer is movable along a plane extending parallel to the respective inner side.

19. The temperature-control unit according to claim 1, wherein the heat-conducting material is a viscous substance that is at least one of deformable elastically and deformable plastically such that the layer of the heat-conducting material follows relative movements between the at least one thermoelectric transducer and at least one of the first contact plate and the second contact plate.

20. The temperature-control unit according to claim 1, wherein the layer of the heat-conducting material extends coextensively across a surface of the coupling zone facing the at least one thermoelectric transducer.

* * * * *